United States Patent [19]

Iwamoto

[11] Patent Number: 4,630,681

[45] Date of Patent: Dec. 23, 1986

[54] MULTI-WELL HYDROCARBON DEVELOPMENT SYSTEM

[75] Inventor: William T. Iwamoto, Berkeley, Calif.

[73] Assignee: Decision-Tree Associates, Inc., Berkeley, Calif.

[21] Appl. No.: 705,092

[22] Filed: Feb. 25, 1985

[51] Int. Cl.[4] ..... E21B 7/12

[52] U.S. Cl. ..... 166/366; 175/5; 175/8; 405/201

[58] Field of Search ..... 166/358, 366; 175/5, 175/7, 8, 9; 405/201

[56] References Cited

U.S. PATENT DOCUMENTS

| | | | |
|---|---|---|---|
| 3,004,612 | 10/1961 | Kofahl | 175/7 |
| 3,033,525 | 5/1962 | Johnson | 405/201 |
| 3,183,676 | 5/1965 | Tourneau | 405/196 |
| 3,451,493 | 6/1969 | Storm | 175/9 |
| 3,477,235 | 11/1969 | Branham et al. | 405/201 |
| 3,556,210 | 5/1969 | Johnson | 166/366 |
| 3,789,921 | 2/1974 | De Chassu et al. | 175/9 |
| 4,033,056 | 7/1977 | Bemmers | 405/201 |
| 4,081,932 | 4/1978 | Armstrong | 405/201 |
| 4,174,011 | 11/1979 | Zaremba | 175/7 |
| 4,401,398 | 8/1983 | Remson | 405/201 |

*Primary Examiner*—James A. Leppink
*Assistant Examiner*—William P. Neuder
*Attorney, Agent, or Firm*—Flehr, Hohbach, Test, Albritton & Herbert

[57] ABSTRACT

A multi-well hydrocarbon development system is economically established and operated by drilling cluster wells through the piles securing the base structure which supports a semisubmersible tension leg buoy through a single leg assembly. The buoy includes a turntable with skid beams on which a drilling rig is slidably mounted so that the rig can be positioned over the piles and cluster wells can be drilled through the piles. Produced fluids are transported into a containment means for separation and storage within the buoy. A captive processing vessel may be moored to the buoy and a means is provided to dispose processed water and/or gas responsibly.

10 Claims, 3 Drawing Figures

MULTI-WELL HYDROCARBON DEVELOPMENT SYSTEM

This invention relates to a multi-well hydrocarbon development system and more particularly to an economically advantageous method of establishing a multi-well system by effecting modifications to a single-well system so that an incremental economic justification procedure can be employed.

The risk-taking element in deepsea drilling and production of oil remains even after the exploration phase. This is particularly the case where a multi-well system is installed before accurately determining the full physical extent of the reservoir and its long term producing characteristics. According to a typical method using a semisubmersible platform, a subsea manifold is disposed on the sea-bed and is connected via subsea pipelines to several subsea production trees at remote wells. Capital expenditures for establishing such an offshore system are generally very large. Should it become necessary for major workover purposes, for example, to position a separate floating system over one of the remote wells, the total expense becomes even higher.

Additional expenses are incurred, furthermore, when land facilities must be upgraded to handle deep draft bulk cargo vessels such as large, very large and ultralarge crude carriers. By limiting the producing system to one well, the volume of production can be carried by shallower draft vessels which can use navigable waterways maintained by agencies such as the U.S. Corps of Engineers. Very few deepwater facilities exist world wide and this severly limits early production and extended reservoir testing production because these reservoirs are generally remote from deepwater ports and cargo terminals. Often, expensive pipelines and/or special deepwater facilities are specially constructed to handle deep draft vessels. Additional expenses can also occur with deep draft vessels which by definition have large widths. Restricted width waterways, such as the Panama Canal, deny passage for such vessels. Shallower, narrower vessels can traverse restricted width waterways, thereby circumventing such problems.

In U.S. patent application Ser. No. 594,309, filed 3-28-84, now abandoned, an economically advantageous deepsea production system suited for single well production was disclosed. This system was unique in that process and storage facilities were integrally incorporated into a tensioned single central leg anchored system. Since it was further designed to occupy a minimum plan view area, the site could be restored easily upon abandonment of the system, should it have become necessary. On the other hand, however, if such a single well system with a relatively slender leg is installed for testing and if tests are good, it may become desirable to drill cluster wells near the original single well.

It is therefore an object of the present invention to provide an economically advantageous multi-well hydrocarbon development system.

It is another object of the present invention to provide a method of modifying a tensioned single central leg anchored system suited for single well production so that a multi-well system can be developed economically.

The above and other objects of the present invention are achieved by providing a base structure secured to seabed by a plurality of piles and a semisubmersible tensioned leg buoy which includes both a containment means for separation and storage and a turntable equipped with skid beams on which a drilling rig is movably mounted. Cluster wells are drilled through the piles and produced fluids are transferred into the containment.

Figure 1:
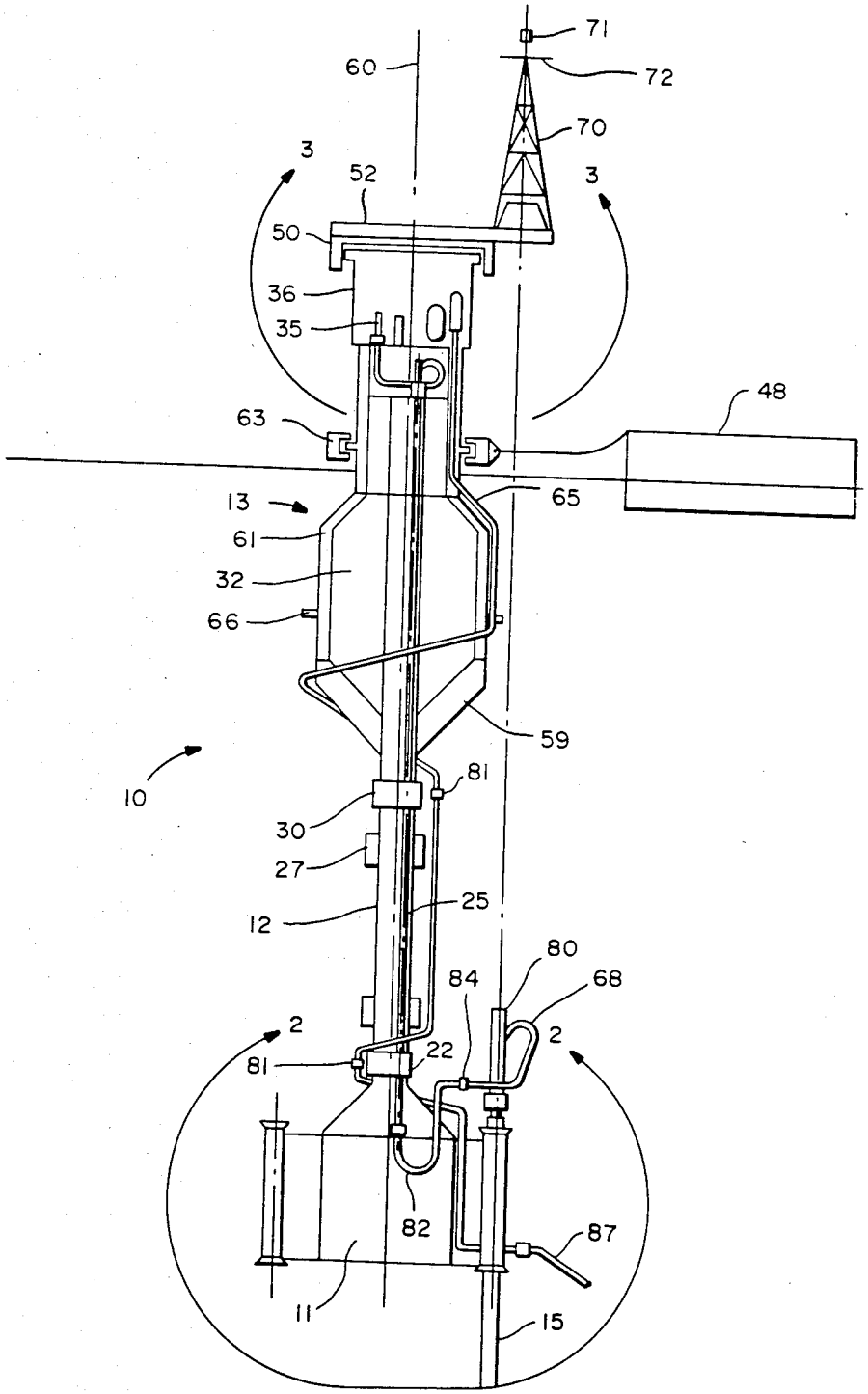
FIG. 1 shows schematically an offshore structure embodying the present invention.
Figure 2:
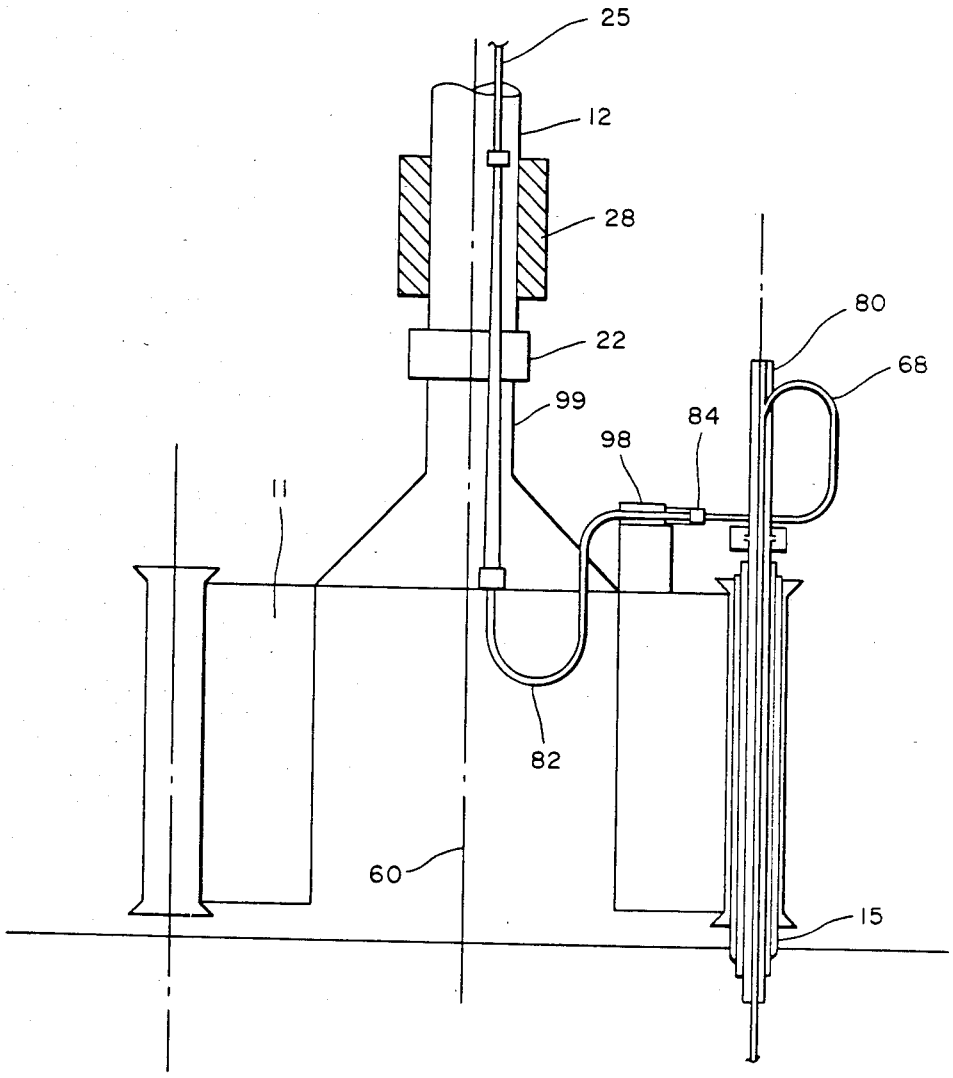
FIG. 2 shows schematically the base structure of the offshore structure of FIG. 1, or the portion of FIG. 1 encircled by line 2—2.
Figure 3:
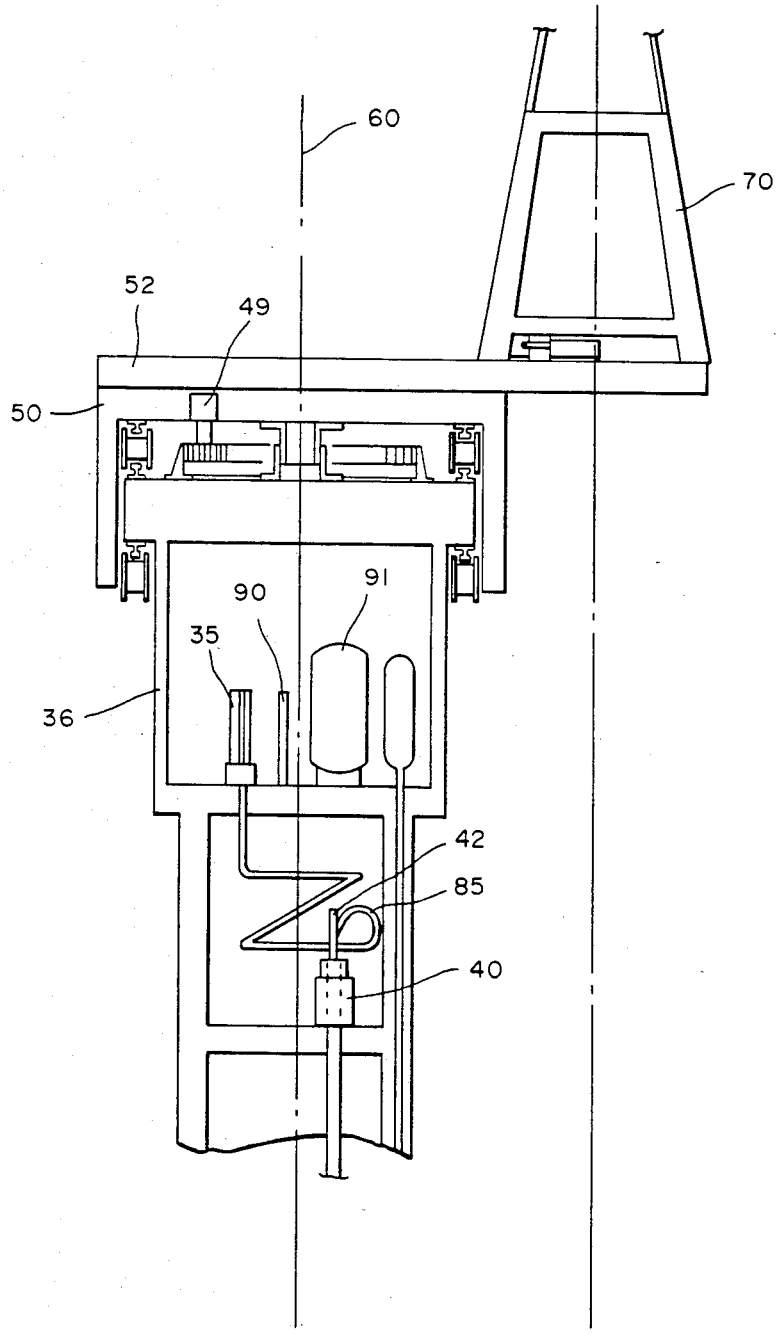
FIG. 3 shows schematically the portion of FIG. 1 encircled by line 3—3.

FIGS. 1 to 3 show schematically an offshore structure 10 according to the present invention for a multi-well hydrocarbon development system, consisting basically of a base assembly 11, a central tension anchor leg assembly 12 and a buoyant body 13. The base assembly 11 is a unit engaged with the sea-bed typically by being secured to piles 15 around a central well (not shown). The central well can be the test well or another well specially drilled for multi-well production. It may be of a conventional design within a central opening sufficiently large cross-sectionally to house therein a wet production tree as well as maintenance space for divers. The base assembly 11 is preferably sufficiently tall to be able to protect such a wet tree from damage by ensuing installation operations and to be able to secure the piles 15 to the base structure, for example, by grouting the annular space between the pile 15 and the base 11.

At the top, the base assembly 11 is connected via a universal joint means 22 to the bottom end of the central tension anchor leg assembly 12. The leg assembly 12 is essentially an elongate member connecting the base assembly 11 to the buoyant body 13 which is essentially a semisubmersible tension leg buoy. At the center, there is an independently tensioned production riser assembly 25 for transporting fluids upwards from a well to the buoyant body 13. The leg assembly 12 itself may be buoyant or non-buoyant, depending upon specific site conditions. A riser tensioning buoy 27 may be provided near the top end of the leg assembly 12 in order to facilitate the vertical positioning of the leg assembly 12 when it is installed vertically onto the base assembly 11. Ballast 28 is used to weigh the bottom end of the leg 12.

The top end of the leg assembly 12 is connected to the bottom of the buoyant body 13 by another universal joint means 30. The floating body 13 has a storage and separation containment means 32 through which the top part of the production riser assembly 25 connects vertically to transport the produced fluids to a dry tree 35 positioned inside a deck structure 36 above the containment 32 and above the sea level. The dry tree 35 may be of a conventionally available type where flow control is exercised by an automatic choke with or without a manual override. It is preferably of a type with two wing valves for production, one active and the other used as a stand-by. This will permit switch-over when the active choke must be replaced or maintained.

The buoyant body 13 is provided with a rotatable turret, or a turntable 50 which is adapted to be power-driven by slewing mechanisms 49 commonly used for offshore crane swingers. Skid beams 52 are affixed radially onto the turntable 50 and a drilling rig 70 with a flare tip 71 at the top is mounted on a substructure which in turn is mounted on the skid beams 52.

The offshore structure 10 is adapted to be used for the development of a multi-well system by using the base peripheral piles 15 for through-the-flow-line (TFL) type subsea trees by drilling cluster wells therethrough along a constant radius from the structure centerline 60 at a distance greater than the maximum below-water dimension of the floating body 13.

The drilling rig 70 is aligned substantially over a cluster well by jacking it to the cluster well radius and by slewing the turntable 50. Alignment may be made over any intermediate radii of interest by the same procedure. The wellbore can be accessed vertically, when necessary, with the assistance of a marine riser system of known type (not shown). Marine riser and riser tensioners commonly used in offshore drilling may be used. The overturning moment to the buoyant body 13 due to the eccentric positioning of the rig 70 can be balanced either by means of counterweights, by differential ballasting or by a combination thereof.

The storage and separation containment means 32 is preferably sized to accommodate several days' production when the production is only from the original single well so that shuttle tanker visitation cycles will be reasonable. The added production of the multi-well system may be sufficiently great to cause a need for a captive processing vessel. One of the shuttle tankers may be converted for this purpose, or another vessel may be constructed or converted. The single well gas-/oil separation surface is sufficient to separate gas within the containment means 32 for the multi-well system. The advantage gained by separating the produced fluids in the containment means 32 relate to the difficulties of fabricating a reliable high-pressure fluid swivel for the turntable 50. If produced fluids were transported from the wellbore directly to the processing vessel without intermediate pressure reduction, fluid swivels capable of reliably operating at well shut-in pressures would be necessary and such fluid swivels would be extremely bulky and/or expensive.

When economically attractive, both gas and oil may be transported by pipelines 87. For this purpose, pipeline risers 65 are supported on the external shell structure by ordinary clamp means. Since concentrated rotations may be anticipated at the universal joints 22 and 30, the risers are formed into helical springs above and-/or below them. The numbers of turns should be determined by the maximum stresses which can be imposed on the pipeline riser 65 by universal joint rotation. Since the vertical centerline of the pipeline riser will not be colinear with the universal joint, a rotation of the joint will cause a vertical movement in the riser. The rotation and vertical movement is accommodated by the aforementioned helical spring action. In lieu of pipelining, the oil and gas liquids may be temporarily stored in the processing vessel and transported to shore by shuttle tankers.

In the multi-well system, produced fluids from the wellbore are transported into the containment means 32 through hard piping means. As shown in FIG. 2 more in detail, the wellbore tubing is connected to a wet tree TFL loop 68 through a wet tree 80 and the loop 68 connects to a base piping 82. The wet tree 80 may be of a conventional type having minimum process functions. Primarily, it is a safety device at the sea floor which fails safe under loss of hydraulic valve pressure. Well control is further achieved by a subsurface safety valve or downhole safety valve (not shown). The piping from the wet tree 80 to the central leg 12 may be prefabricated with sufficient flexibility so that it can be extended axially by hydraulic cylinders 98 to mate with TFL loop connector 84. The connector 84 may be secured to the piping by hydraulically activated mechanical means. The piping end at the base of the central leg 12 aligns vertically with the integral production riser 25 but the central leg 12 contains the lower universal joint 22 near this piping juncture. The concentrated rotation of the universal joint 22 is preferably accommodated by steel alloy or titanium stress joints 99 which are specially designed flexural joints with high fatigue resisting properties. Ball joints may alternatively used for this purpose.

The production riser 25 is a tubular housing in which production tubing, annulus monitor tubing and hydraulic control lines (not shown) are contained inside. It generally consists of several sections connected to one another until the required length is achieved to reach the upper universal joint 30 where stress or ball joints accommodate its concentrated rotation. The topmost section of the production riser 25 passes through a center hole hydraulic cylinder 40 which applies tension to the entire riser string. The terminus of the production riser 25 is a Y-spool 85 which transforms the riser section back to individual tubing without an external housing. The tubing is wound one round turn or more in helical spring fashion, terminating at their designated bores (not shown) in the dry tree 35. The springing action is designed to accommodate the tension ram stroking. The entire piping system is hard piped except for the aforementioned ball joints. These ball joints have a specially designed elastomeric composition, providing equivalent hard piping qualities.

As best seen in FIG. 3, the Y-spool 85 allows an independent entry point 42 for pumpdown TFL tools commonly used for minor workovers. The individual bores of the dry tree 35 can therefore be used for pressure sensitive monitoring devices which need not be removed when workovers are performed on its cluster well. Further piping runs occur between the wing valves of the dry tree and the containment means 32. The dry tree bores are normally equipped with a master valve and wing valve. These valves may be remotely actuated, manually operated or remotely actuated with manual override. Generally, pipe commencing at the wing valve is connected to a remotely controlled emergency shutdown valve, production choke, maintenance required block valve, flow direction control check valve (not shown), finally terminating at a production manifold 90.

The manifold 90 is a multi-piped and valved assembly which can direct flow to various components in the processing system, such as a separator 91, intermediate production separator (not shown) or the containment means 32. Intermediate production separators are sometimes required to reduce the pressure of the well stream fluid in stages rather than in one stage. The produced fluids are ultimately piped from the manifold 90 to the container means 32. This method of piping uses high pressure containing components of hard piping as opposed to flexible, hose-type conduits. An added advantage is that sour hydrocarbon production requiring the use of metal-to-metal seals (gaskets) in all high pressure piping is readily accommodated by industry available off the shelf items. Basically, the vertical restraint provided by the central leg 12 to the buoyant body 13 reduces the vertical movement of the production riser 25 to a practical distance wherein hard piping in helical form accommodates vertical movement of the production riser 25. Vertical movement occurs in the production riser 25 as a result of its own axial elasticity and the relative location of its vertical centerline with respect to the centerline 60 of the buoyant body 13.

The containment 32 is further provided with a fixed ballast 59 at the bottom. The fixed ballast 59 may be of varying density such as for drilling muds and can perform several functions besides keeping the center of gravity of the buoyant body 13 safely low and to minimize tension on the leg assembly 12. For example, the buoyant body 13 may be towed to the site in a horizontal position. Filling the fixed ballast compartment 59 causes it to upend to a vertical preinstallation position. Its weight can also be adjusted to compensate for various deck weights. A high deck weight will require a reduction in fixed ballast weight but only to the extent that the relationships between the vertical center of gravity (VCG) and the vertical center of buoyancy (VCB) are safely maintained. Thus, a relatively wide range of deck weights can be accommodated without changing the geometric configuration of the submerge structure. The VCG-VCB relationship also becomes increasingly important in the case of unintentional disconnection between the central leg 12 and the buoyant body 13 or between the base structure 11 and the central leg 12.

The interior of the containment 32 is segregated from the sea by surrounding ballast compartments 61. The external walls of the containment 32 are of a compartmentalized structure divided into a number of vertically elongate parallel chambers so that the containment 32 can be deballasted suitably as product accumulates inside and deballasting further controls the tension to the base assembly 11 and the central tension anchor leg assembly 12 to approximately uniform levels. Liquid level in the containment 32 is constantly measured by level indicators (not shown) which feed data into a microprocessor which in turn controls ballasting and deballasting. Measured liquid level is telemetered to shore at all times. In addition, low and high level telemetered alarms may be provided to trigger shutdown. Since the required tension can be designated with some tolerance included, diametrically opposite pairs of peripheral ballasting compartments can be designated to be left void to increase buoyance, thus offsetting weight gains of the produced liquids. Alternatively, the fixed ballast density may be changed. On the outer surface of the external wall of the containment means 32 is a disk-shaped heave attenuater 66 for increasing the vertical drag.

The production riser 25 may be made buoyant, if necessary, by filling the annular space between its internal tubing and outer housing with low density material such as syntatic foam, low density liquid or compressed air. Normally, the annulus has open communication to the surrounding seawater so that hydrostatic balancing of external and internal pressure on the housing is maintained when submerged. Open communication can therefore reduce the structural strength requirements of the housing.

Syntatic foams are currently used to buoy drilling risers by applying foam panels externally to the riser surface. The foams resistance to hydrostatic collapse is governed by the chemical composition of the foam mixture which also affects its density. Riser lightening devices such as those mentioned above reduce the tensioning capacity of the riser tensioners. Thus, the minimum amount of tension in the central leg 12 can be maintained to control internal stresses. Also, externally attached foam panels to the central leg 12 can reduce the overall buoyancy requirement of the buoy as may be required in extremely deep water. In other words, the buoyancy attached to the central leg 12 will allow the same buoy dimensions for a wide range of water depths.

The present invention has been described above in terms of only a limited number of examples both relating to the structure and the method of using the same but the description above should be regarded as illustrative rather than as limiting, and should therefore be construed broadly. For example, the accompanying figures are intended to be schematic and not to represent any preferred dimensional relationships or shapes of the various components. Although a design with two joints have been shown, the number of universal joint means in the system is by no means limited to two. The system may be installed without the center leg especially in the case of shallow water depths. In other words, the floating body 13 may stab onto the base structure 11 directly.

When multi-well production is too great, for example, and a processing-storage vessel 48 is required as mentioned briefly above, such a vessel may become captive to the buoyant body 13, or it may have to be moored to the buoyant body 13. The forces to the buoyant body 13 become greater for the captive vessel case because they attract wave forces. Thus, a mooring turntable 63 may be provided separately from the aforementioned turntable 50 in order to reduce the overturning moment effect of the processing vessel by reducing the height of the mooring connection. Such mooring turntable is not required for low production case because shuttle tankers moor only occasionally and, by definition, a shuttle tanker cannot moor when sea conditions are too severe to connect its mooring line. The mooring turntable 63 is particularly important during well drilling or workover of a cluster well because once the drilling rig 70 is indexed over a cluster well, its position is globally fixed and the support vessel can no longer weathervane freely around the floating body 13 although it may be able to head its bow into the seas by dynamic assistance from thruster means. If the support vessel is a semisubmersible configuration designed to be less sensitive to sea directions, it may be moored in the same radial direction with respect to the centerline 61 as the cluster well. This arrangement is superior because the utility bundle including hoses, electrical cables, etc. is less prone to damage.

The produced liquids may be separated and the oil may be shipped from the site via submarine pipeline 87. The produced water can be treated on a process vessel 48 and disposed at sea. The basic reason for submarine pipelines, however, is the responsible disposal of gas from the site. Gas flares should be used only for emergency disposal when large quantities of gas are produced as in the multi-well case. After gas processing, the best method of handling gas is via submarine pipelines. When used, however, the gas flame above the flare tip 71 creates a great amount of heat. A heat shield 72 therefore is provided atop the drilling derrick to protect the items below the flame.

Water and gas treating facilities are generally complex and extensive from the point of view of equipment. When there is inadequate room on the deck structure of the buoyant body 13, the captive processing vessel should be utilized for this purpose. A fluid swivel is typically required for flows from the buoyant body 13 (for produced liquids and produced gas to process vessel) and another for flows back from the process vessel (for treated gas for pipeline or injection, treated water for injection and treated oil for pipeline).

In summary, it is to be understood that the scope of the invention is defined only by the following claims.

What is claimed is:

1. An offshore structure for development of a multi-well system by drilling through at least one of a plurality of piles securing a base structure for a center well to the seabed, comprising a buoyant body connected to said base structure through at least one universl joint means such that vertical motion of said buoyant body is substantially attenuated, said buoyant body including a containment means adapted to store and separate produced fluids, a compartmentalized external shell surrounding said containment means for ballasting and deballasting, a turntable above said containment means, skid beams affixed onto said turntable, a drilling rig mast means slidably mounted on said skid beams, and a jack means for moving said drilling rig means with respect to said skid beams, said turntable and said jack means being adapted to function cooperatively to position said drilling rig means over one of said piles.

2. The structure of claim 1 wherein said drilling rig means further includes a flare tip.

3. The structure of claim 2 wherein said drilling rig means further includes a heat shield below said flare tip.

4. The structure of claim 1 further comprising a central tension anchor leg assembly attached to and disposed between said base structure and said buoyant body.

5. The structure of claim 1 wherein said buoyant body further includes a mooring turntable.

6. The structure of claim 1 wherein said buoyant body further includes a dry tree means.

7. The structure of claim 1 wherein said buoyant body further includes a pipeline riser assembly.

8. A method for development of a multi-well system comprising the steps of providing a base structure secured to the seabed by piles, a buoyant body connected to said base structure and including a containment means adapted for storage and/or processing, a production riser assembly passing through said containment means, a turntable with skid beams affixed thereonto, and a drilling rig movably disposed on said skid beams, positioning said rig over one of said piles by rotating said turntable and moving said rig with respect to said skid beams, drilling a cluster well through said one pile, and transporting produced fluids from said cluster well through said riser assembly into said containment means.

9. The method of claim 8 further comprising the step of mooring a processing vessel to said buoyant body and transporting fluids from said containment means to said processing vessel.

10. The method of claim 9 further comprising the step of transporting processed fluids from said vessel for disposal through a manifold provided on said floating body.

* * * * *